US010070745B2

(12) United States Patent
Blevins

(10) Patent No.: US 10,070,745 B2
(45) Date of Patent: Sep. 11, 2018

(54) VERSATILE HANGER RETAINER APPARATUS AND METHODS OF USE

(71) Applicant: Randall Blevins, Memphis, TN (US)

(72) Inventor: Randall Blevins, Memphis, TN (US)

( * ) Notice: Subject to any disclaimer, the term of this patent is extended or adjusted under 35 U.S.C. 154(b) by 0 days.

(21) Appl. No.: 15/008,320

(22) Filed: Jan. 27, 2016

(65) Prior Publication Data

US 2018/0064275 A1 Mar. 8, 2018

(51) Int. Cl.

| | |
|---|---|
| ***A47G 25/06*** | (2006.01) |
| *A47G 25/14* | (2006.01) |
| *A47G 25/32* | (2006.01) |

(52) U.S. Cl.

CPC ..... *A47G 25/06* (2013.01); *A47G 25/0607* (2013.01); *A47G 25/0692* (2013.01); *A47G 25/1414* (2013.01); *A47G 25/32* (2013.01)

(58) Field of Classification Search

CPC ..... A47G 25/06; A47G 25/0607; A47G 25/0614; A47G 25/0621; A47G 25/0678; A47G 25/0692; A47G 25/0685; A47G 25/1414; A47G 25/32; A47G 25/325; A47G 25/28; F16M 13/022; F16L 3/137; F16L 3/1218; F16L 3/122; F16L 3/00; F16L 3/08; F16B 2/20; F16B 2/22; F16B 2/246

USPC ..... 248/339, 340, 317, 316.1, 316.6, 316.7, 248/315, 316.5, 309.1, 313, 215, 227.4, 248/227.1, 230.8, 231.81, 690–692

See application file for complete search history.

(56) References Cited

U.S. PATENT DOCUMENTS

| | | | | |
|---|---|---|---|---|
| 1,521,619 | A * | 1/1925 | Haas | 24/116 A |
| 2,058,963 | A | 10/1936 | Drummond | |
| 2,246,229 | A * | 6/1941 | Wohlmuth | A22C 15/008 24/130 |
| 3,620,376 | A * | 11/1971 | Gingher | A47G 25/0692 211/113 |
| 3,685,189 | A | 8/1972 | Conger | |
| 4,335,839 | A * | 6/1982 | Kessler | A45F 5/10 248/340 |
| 6,094,784 | A | 8/2000 | Schrader | |
| D455,064 | S | 4/2002 | Shih | |
| 7,464,910 | B1 * | 12/2008 | St. Germain | G10G 5/00 211/85.6 |
| 7,568,673 | B2 * | 8/2009 | Evingson | A45F 3/20 220/375 |
| 7,703,735 | B2 * | 4/2010 | Fryer | A47F 5/0006 24/372 |
| 7,828,258 | B2 | 11/2010 | Shigio et al. | |

(Continued)

*Primary Examiner* — Nkeisha Smith

(74) *Attorney, Agent, or Firm* — William S. Parks

(57) ABSTRACT

A portable retainer apparatus, and more specifically to a portable retainer apparatus adapted to retain a hanger when applied to and/or over a number of different surfaces is provided. Furthermore, the disclosure may further relate to a method for retaining a hanger with the apparatus in order to accord a user the benefit of hanging an apparel article outside or inside of a shower in order to dewrinkle such an article. The subject portable retainer apparatus exhibits the ability to carry such a retainer device and then place, on demand, such a device over a shower rod, shower door, shower door cover, shower wall, and the like, with a proper configuration to dispose of the subject apparel article at a selected distance near or away from a shower curtain or door when in use to maximize the benefits of heated shower moisture and steam for the above-noted purpose.

16 Claims, 9 Drawing Sheets

(56) References Cited

U.S. PATENT DOCUMENTS

| | | | | |
|---|---|---|---|---|
| D646,151 | S | 10/2011 | Potts et al. | |
| D682,075 | S | 5/2013 | Pierce | |
| 8,882,059 | B2 * | 11/2014 | Schmidt | F16L 3/1041 248/56 |
| 9,080,715 | B2 | 7/2015 | Biddle et al. | |
| 9,314,123 | B1 * | 4/2016 | Schlang | A47G 25/1442 |
| 2002/0047073 | A1 * | 4/2002 | Deciry | H02G 3/32 248/49 |
| 2015/0144277 | A1 * | 5/2015 | Courvisier | A47H 13/01 160/332 |
| 2015/0306447 | A1 * | 10/2015 | Neal-Buhler | A63B 21/16 248/231.81 |
| 2016/0039569 | A1 * | 2/2016 | Mcmahon, III | F16M 13/02 220/23.83 |

* cited by examiner

VERSATILE HANGER RETAINER APPARATUS AND METHODS OF USE

FIELD OF THE INVENTION

The disclosure relates to a portable retainer apparatus, and more specifically to a portable retainer apparatus adapted to retain a hanger when applied to and/or over a number of different surfaces. Furthermore, the disclosure may further relate to a method for retaining a hanger with the apparatus in order to accord a user the benefit of hanging an apparel article outside or inside of a shower in order to dewrinkle such an article. The subject portable retainer apparatus exhibits the ability to carry such a retainer device and then place, on demand, such a device over a shower rod, shower door, shower door cover, shower wall, and the like, with a proper configuration to dispose of the subject apparel article away from a shower curtain or door when in use to maximize the benefits of heated shower moisture and steam for the above-noted purpose. The retainer thus includes integrated structures to provide the needed, on-demand placement possibilities in relation to a shower door and/or curtain. A hook (whether open or possibly closed in configuration) and an indentation (to slide over a plastic or glass shower door) are thus included for such a purpose, with a hanger connection (separate hook or opening for secure placement of a convertible hookless structure, such as a ball-type hanger) to place in an opening on the end opposite the integrated attachment portions. The method of utilization of such a device is further encompassed within this invention.

BACKGROUND OF THE INVENTION

Hotel patrons, particularly those who travel frequently and/or extensively, are typically individuals that wear business apparel for their trips. As such, it is customary for such persons to seek a manner to facilitate dewrinkling certain apparel articles (shirts, blouses, pants, skirts, as examples) prior to wearing. Such hotels frequented by business travelers may include an iron for such apparel treatment purposes; however, such irons have been known to have undesirable physical issues (such as surface rust, accumulated starches, and other potentially staining or deleteriously effecting an apparel fabric in use). Additionally business travelers are often short on time and therefore must seek timely and efficient methods to prepare apparel prior to wearing. Furthermore, the necessity for potential harmful elevated temperatures during an ironing exercise may prove difficult for a user to undertake without potentially harming themselves or others. Thus, the most reliable and, effectively easiest, manner of providing a dewrinkling activity (particularly on demand) in this situation is through exposure to standard shower provided steam and moisture. The individual threads of such an apparel are susceptible to wrinkling, certainly, particularly if they are cotton or cotton blends. Water, particularly as steam, facilitates introduction and contact within the interstices of fibers of such an apparel fabric, thereby providing such wrinkle removal actions. Thus, in order to avoid time-consuming and potentially dangerous ironing, travelers are known to hang such apparel articles in a bath room to provide steam exposure while the shower is in use. The available structures for such a purpose are limited to hangers themselves, leaving the user with having to utilize either a specific hanger structure of their own or from the hotel, placing the hanger over the curtain rod or perhaps over a provided towel rod support. Such an activity, unfortunately, leads to uncertainty for the user due to the distance away from or too close to the water/steam source, as well as contact with other surfaces wherein the apparel article contacts the shower curtain or door, thus making it difficult for the water/steam sources to act accordingly over the apparel's entirety. In that manner, a structure that would allow hanging on demand near a water source would be highly desirable, particularly in an all-in-one portable fashion, and further for any type of apparel hanger implement (whether standard hook, small hook, ball-type hanger in type, for instance)(small hook hangers will generally not fit over standard shower curtains circumferences, thus, this device allows for such a versatile capability). Typical actions utilized for travel dewrinkling purposes include, unfortunately, portable irons and/or steamers (that are cumbersome to transport and require upkeep, including water removal, to ensure proper utilization on demand). The time and physical activities needed for operation militate against such use. The ability for tacit dewrinkling by shower steam and/or moisture is preferable for a number of reasons; however, short of standard hangers and possibly integrated or supplied laundry lines over and/or within a bathtub/shower (which are susceptible to water coverage, rather than only steam), such actions are limited and generally in effective, not to mention such a standard hanger may not fit over every shower separator surface. An apparatus that allows for standard hanger, small hook hanger, ball-type topless hanger, etc., utilization and disposition at a selected distance near or away from a shower separator (curtain, door, etc.) for maximum steam and moisture exposure for a subject apparel article, that can further be placed over any shower separator implement, whether a curtain rod, shower door, or other shower surface, would be very desirable, particularly within the business traveler industry.

Advantages and Brief Summary of the Invention

A distinct advantage of the versatile apparatus now disclosed is the provision of a single portable structure that includes shower separator placement portions and simultaneously an extended hanger retention portion. Another advantage is the small profile of such an apparatus to permit simple transport within luggage, and the like, and simple placement on demand over a shower separator (curtain rod or shower door), room door, or shower wall, for such hanger implement access.

The disclosure provides a hanger retainer apparatus. The apparatus may be capable of supporting a clothes hanger in spaced relation to a room feature. In embodiments, the room features may comprise shower rods, shower rod/curtain/door surfaces, and glass shower door frames. The apparatus may comprise a portable unitary piece including a body. The body may have first and second faces disposed in opposed parallel relation. The body may have an interior portion that may define an interior of a major hook portion. The major hook portion may further comprise a first end spaced from a second end, an extended body extending from the first end to the second end, and an exterior portion. In embodiments, the extended body may be positioned in a curved ovular (or circular, or any other like curved shape) configuration. The curved ovular (or other curved shape) configuration may aid in positioning the apparatus around a portion of a shower rod as well as, with proper spacing, provide an implement to fit securely over a squared or like geometric shower edge cover when turned opposite the direction of the curved configuration's placement over and partially around a shower rod (thus permitting utilization over a square door article, particularly those typically utilized for ingress and egress of bathrooms). The apparatus may further include an indentation disposed at a position opposite the curved ovular (or other curved shape) configuration that is of sufficient size and shape to fit over a glass or plastic (or other like material) shower door with the major hook portion extended outwardly therefrom to permit retention of a garment through the utilization of a hanger (as described herein). Additionally, such a hanger retainer apparatus may, in possible embodiments, include any number of accoutrements, including, without limitation, and certainly without any requirement that such be present therein: a magnet on the back portion of said apparatus opposite the curved configuration for potential contact and secure retention thereon a metal surface; a surface on such an opposing location from the curved configuration for placement of a suction device for attachment to a suitable surface; a narrow edge present within the major hook portion for utilization as a screw driver and/or bottle opener (or a narrow edge additionally or solely present within the edge of the indentation portion for a similar purpose); indices provided on the face of the apparatus opposite the curved configuration as measurements of centimeters, millimeters, and/or inches for a ruler component; a sharp edge situated within the major hook portion within the confines of the gap present within its extended portion to act as a thread cutting implement on demand and without potential for a person to introduce his or her finger(s) therein; and the storage of telescoping arms therein to extend therefrom on demand for stabilization purposes. Additionally, in certain embodiments, the retainer apparatus may also be placed flat on a surface to act as a proper holding device for a cell phone or smart phone, ostensibly allowing the user to place such a phone within the geometric curved configuration and the extended major hook portion either lengthwise or widthwise to provide a hands-free manner of viewing such a device on demand. The overall apparatus may be manufactured from any number of materials, including, without limitation, metals, polymers, wood, and any combinations thereof. The major hook portion may, in embodiments, also exhibit a certain degree of flexibility to allow for a user to widen the opening of the curved configuration to encompass a subject shower rod, squared cover, door, and the like, and flex thereover to securely hold such an apparatus in place.

The body may define elements of a protruding portion. The protruding portion may comprise an exterior surface. The protruding portion may extend a defined distance from the exterior portion of the major hook portion.

The body may define elements of a first indentation. The first indentation may extend a defined distance within the protruding portion.

The body may define elements of a minor hook portion comprising a first extension portion, a second extension portion, a curved end, an interior surface, and an exterior surface. The first extension portion and the second extension portion may be positioned in a perpendicular relationship therewith.

The body may further define elements of a second indentation adapted to receive a portion of a hanger. The second indentation may protrude from a side surface of the minor hook portion and may extend a defined distance within the minor hook portion.

The disclosure may provide a method. The method may comprise providing a hanger retainer apparatus. A shower element may then be inserted into one of the major hook portion and the first indentation. Method may further include positioning a portion of a hanger adjacent at least one of a major hook portion and a second indentation. When a hanger with a garment is hung from the apparatus within a room with a shower, the steam from the shower may decrease the amount of or eliminate wrinkles that may exist on the garment.

These and other aspects of the disclosed subject matter, as well as additional novel features, will be apparent from the description provided herein. The intent of this summary is not to be a comprehensive description of the subject matter, but rather to provide a short overview of some of the subject matter's functionality. Other systems, methods, features and advantages here provided will become apparent to one with skill in the art upon examination of the accompanying FIGURES and detailed description. It is intended that all such additional systems, methods, features and advantages that are included within this description, be within the scope of any claims filed now and/or later.

BRIEF DESCRIPTION OF THE DRAWINGS

The novel features believed characteristic of the disclosed subject matter will be set forth in any claims that are filed now and/or later. The disclosed subject matter itself, however, as well as a preferred mode of use, further objectives, and advantages thereof, will best be understood by reference to the following detailed description of an illustrative embodiment when read in conjunction with the accompanying drawings, wherein:

DETAILED DESCRIPTION OF ILLUSTRATIVE EMBODIMENTS

Reference now should be made to the drawings, in which the same reference numbers are used throughout the different FIGURES to designate the same components.

It will be understood that, although the terms first, second, third, etc. may be used herein to describe various elements, these elements should not be limited by these terms. These terms are only used to distinguish one element from another element. Thus, a first element discussed below could be termed a second element without departing from the teachings of the present disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising"

or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
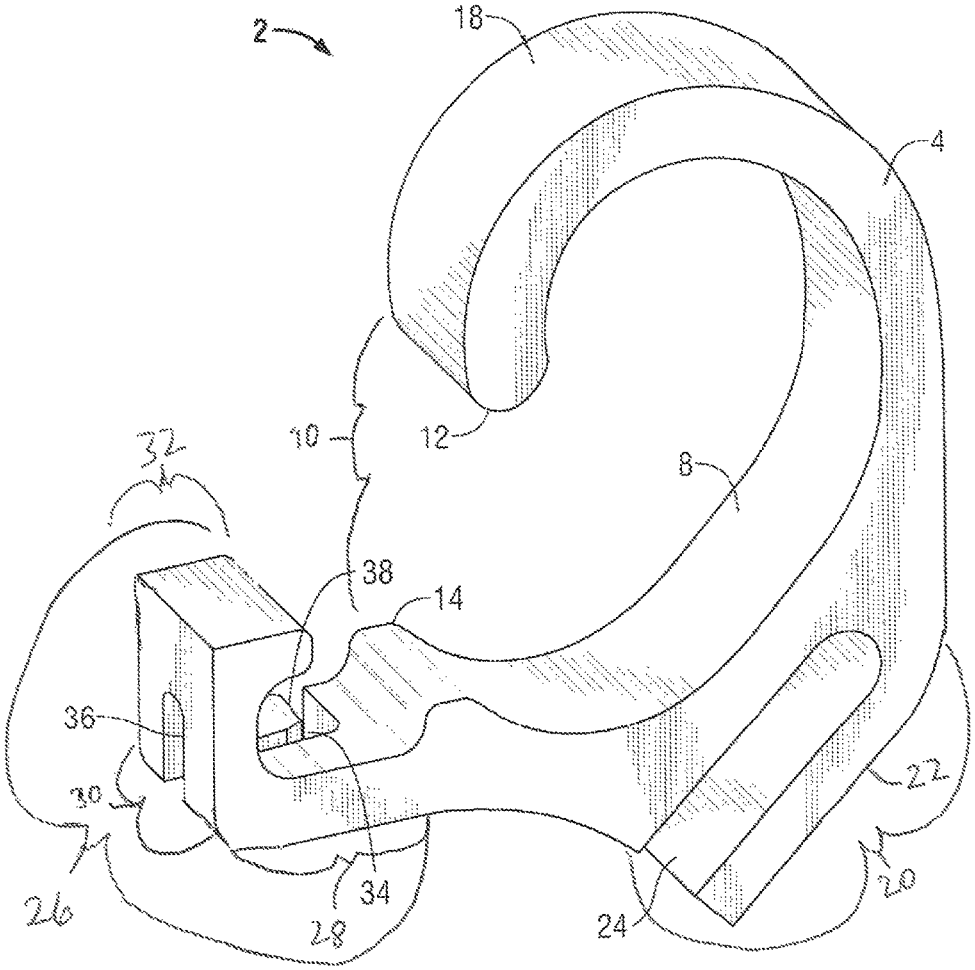
FIG. 1 depicts a perspective view of a hanger retainer apparatus in accordance with embodiments.

FIG. 1 depicts a perspective view of a hanger retainer apparatus 2 in accordance with embodiments. The apparatus 2 may be capable of supporting a clothes hanger in spaced relation to a room feature. In embodiments, the room features may comprise shower rods and glass shower door frames and shower walls. The apparatus 2 may comprise a portable unitary piece including a major hook portion 10. The major hook portion 10 may have first and second faces 4,6 disposed in opposed parallel relation (the second face 6 at least partially shown in FIGS. 3, 4, and 5). The major hook portion 10 may have an interior portion 8 that may define an interior thereof. The major hook portion 10 may further comprise a first end 12 spaced from a second end 14, and an exterior portion 18. In embodiments, the major hook portion 10 may be positioned in a curved ovular configuration. The curved ovular configuration may aid in positioning the apparatus 2 around a portion of a shower rod.

Figure 5:
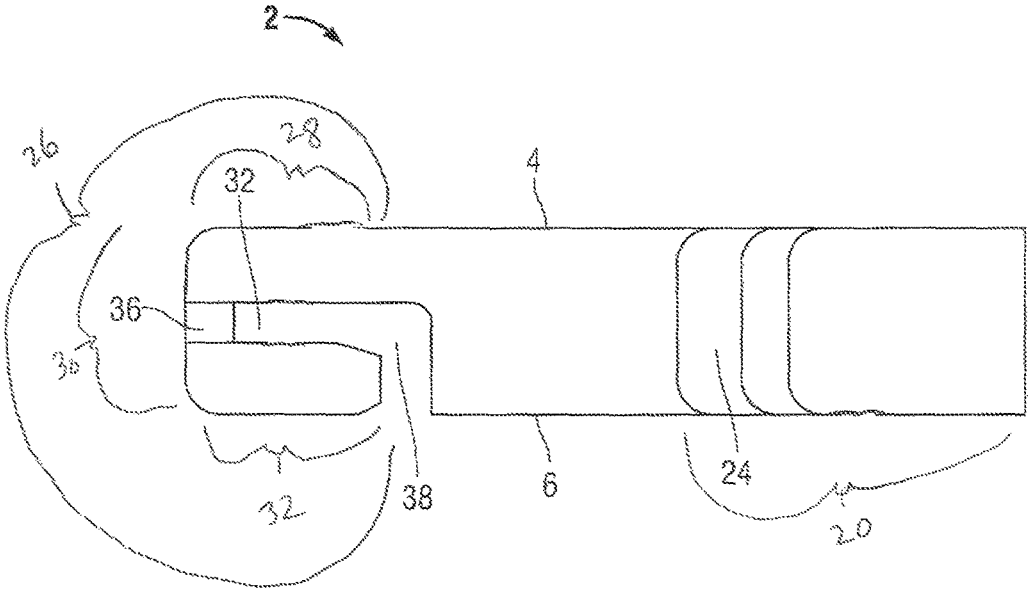
FIG. 5 depicts a bottom view of a hanger retainer apparatus in accordance with embodiments.

The major hook portion 10 may define elements of a protruding portion 20. The protruding portion 20 may comprise an exterior surface 22 as shown in FIG. 5. The protruding portion may extend a defined distance from the exterior portion 18 of the major hook portion 10. In embodiments, an edge of the exterior surface 22 may align along a tangent of the interior portion 8 of the major hook portion 10. In embodiments, a second edge of the exterior surface 22 may align along a tangent of the exterior portion 18 of the major hook portion 10.

The major hook portion 10 may define elements of a first indentation 24. The first indentation 24 may extend a defined distance within the protruding portion 20. In embodiments, the first indentation 24 may extend along an axis parallel with the portion of the exterior surface 22 aligning along a tangent of the interior portion 8 of the major hook portion 10.

The apparatus 2 may define elements of a minor hook portion 26 comprising a first extension portion 28, a second extension portion 30, a curved end 32, an interior surface 34, and an exterior surface 36. The first extension portion 28 and the second extension portion 30 may be positioned in a perpendicular relationship therewith. The first extension portion 28 may terminate at the second end 14 of the major hook portion 10 and may be defined between the second end 14 of the major hook portion 10 and the second extension portion 30.

The minor hook portion 26 may further define elements of a second indentation 38 adapted to receive a portion of a hanger. The second indentation may protrude from a side surface of the minor hook portion 26 and may extend a defined distance within the minor hook portion 26. In embodiments, the second indentation 38 may be continuous along a portion of the first extension portion 28 and a portion of the second extension portion 30. In embodiments, second indentation 38 may terminate at a rounded end.

Figure 2:
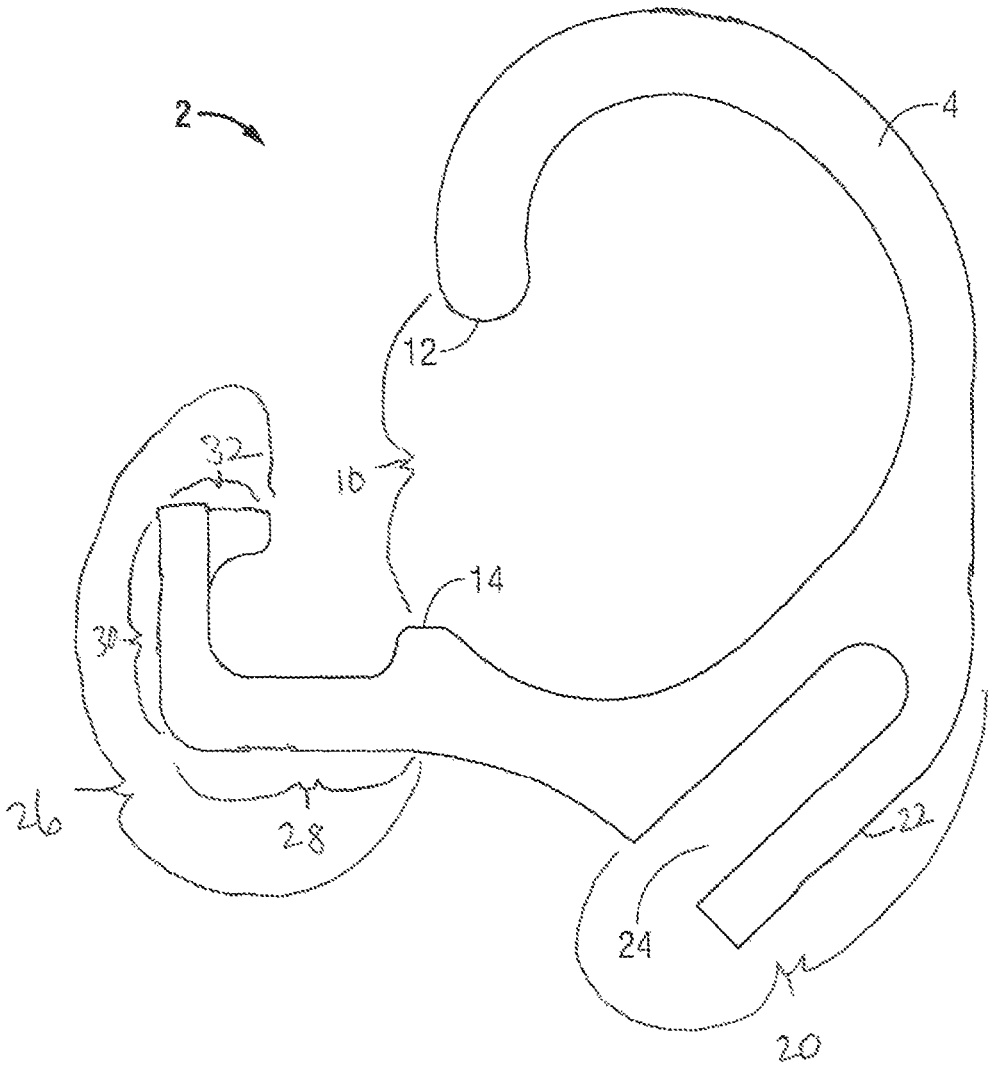
FIG. 2 depicts a side view of a hanger retainer apparatus in accordance with embodiments.

FIG. 2 depicts a side view of a hanger retainer apparatus 2 in accordance with embodiments. The first indentation 24 may be shown terminating within the protruding portion 20 at a rounded end. In embodiments, the first indentation 24 may be wide enough to allow for a glass shower door frame to be slid within the first indentation 24. When the apparatus 2 is affixed to at least a portion of a glass shower door frame, hook-ended hangers may be hung on the interior portion 8 (FIG. 1) of the major hook portion 10 and ball-ended hangers may be hung within the second indentation 38 (FIG. 1) of the minor hook portion 26.

In embodiments, the distance between the first end and the second end of the major hook portion 10 may be wide enough to allow a shower rod to fit through that distance. Once the distance is cleared, the major hook portion may be affixable around at least a portion of the shower rod, allowing the apparatus 2 to hang from the shower rod. This positioning may allow for hook-ended hangers to be hung on the interior portion 8 of major hook portion 10 and ball-ended hangers to be hung within the second indentation 38 of the minor hook portion 26. In embodiments, the distance between the first end and the second end of the major hook portion 10 may be 1.5 inches.

Whether the apparatus 2 is affixed to at least a portion of a shower rod or to at least a portion of a glass shower door frame, a ball-top hanger may be positioned within the second indentation 38 of the minor hook portion 26. In order to allow for the ball end to be more secure within the second indentation 38, the second indentation may further comprise a recessed portion that may be positioned within at least one of the first extension portion 28 and the second extension portion 30. The recessed portion may resemble that of a bowled-out area in which the ball end may comfortably fit. Depending on the orientation of the apparatus 2, the recessed portion may be positioned on at least one of the exterior surface 36 of the minor hook portion 26 and the interior surface 34 of the minor hook portion 26.

In embodiments, the curved end 32 of the minor hook portion 26 may inwardly extend toward the interior surface 8 of the major hook portion 10.

In embodiments, the first end 12 of the major hook portion 10 may inwardly extend toward the interior surface 8 of the major hook portion 10. In embodiments, the second end 14 of the major hook portion 10 may outwardly extend away from the interior surface 8 of the major hook portion 10.

Figure 3:
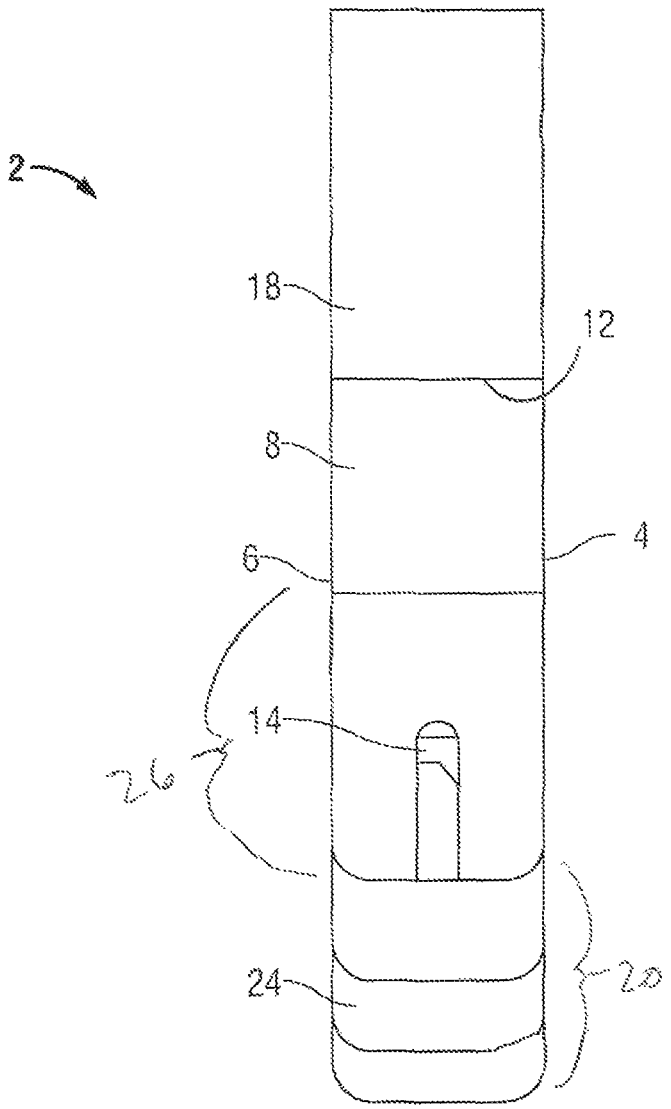
FIG. 3 depicts a front view of a hanger retainer apparatus in accordance with embodiments.
Figure 4:
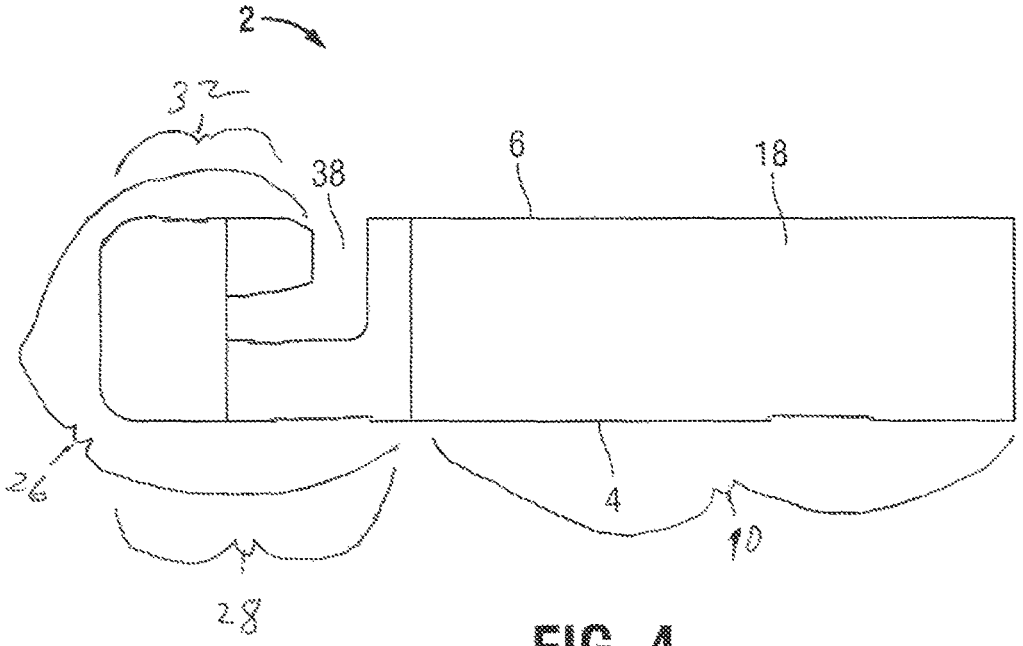
FIG. 4 depicts a top view of a hanger retainer apparatus in accordance with embodiments.

Elements of the apparatus 2 may be defined between the first and second faces 4,6, as shown in FIGS. 3, 4, and 5.

Figure 6:
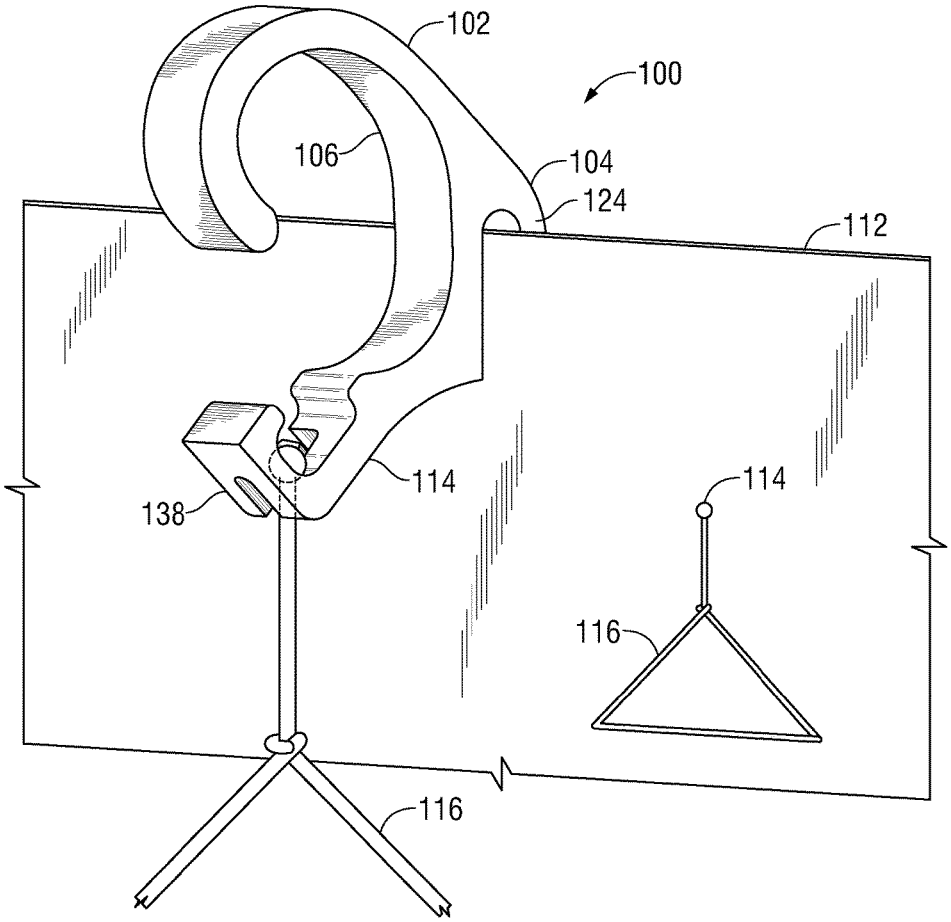
FIG. 6 depicts a method for retaining a standard hanger with an apparel article in accordance with embodiments.

FIG. 6 displays a method for retaining a hanger. The method may utilize any aforementioned configurations of apparatus 102. Method 100 may comprise providing 110 a hanger retainer apparatus 102. A shower door element 112 may then be inserted into the first indentation 124. Method 100 may further include positioning a ball-top portion 114 of a ball-top hanger 116 adjacent at least one of a major hook portion 110 and a second indentation 138. When a hanger with a garment is hung from the apparatus 102 within a room with a shower, the steam from the shower may decrease the amount of or eliminate wrinkles that may exist on the garment.

In embodiments, at least a portion of the first and second faces 104, 106 may comprise sharp edges. In embodiments, at least a portion of the first and second faces 104, 106 may comprise rounded edges.

In embodiments, apparatus 102 may comprise a polymer. In embodiments, apparatus 102 may be completely comprised of a polymer, including, without limitation, polyethylene, polypropylene, polyacrylate, polycarbonate, and the like).

In embodiments, apparatus 102 may comprise a metal. In embodiments, apparatus 2 may be completely comprised of a metal (such as brass, aluminum, stainless steel, and the like, without limitation). Additionally, such an apparatus 102 may be comprised of a wooden material (including, without limitation, bamboo, cedar, cherry, walnut, mahogany, and the like).

Figure 7:
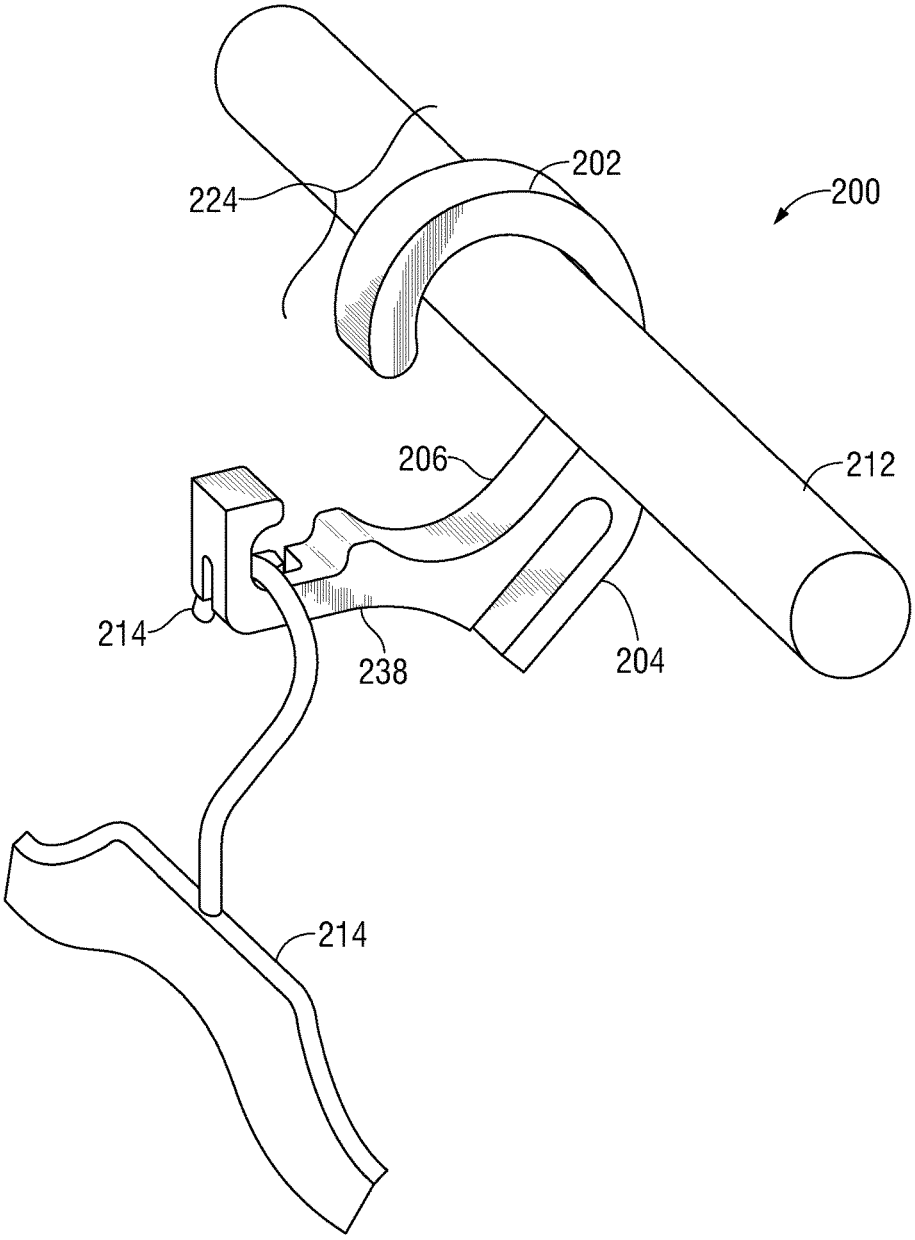
FIG. 7 depicts a method for retaining a topless hanger with an apparel article in accordance with embodiments.
Figure 8:
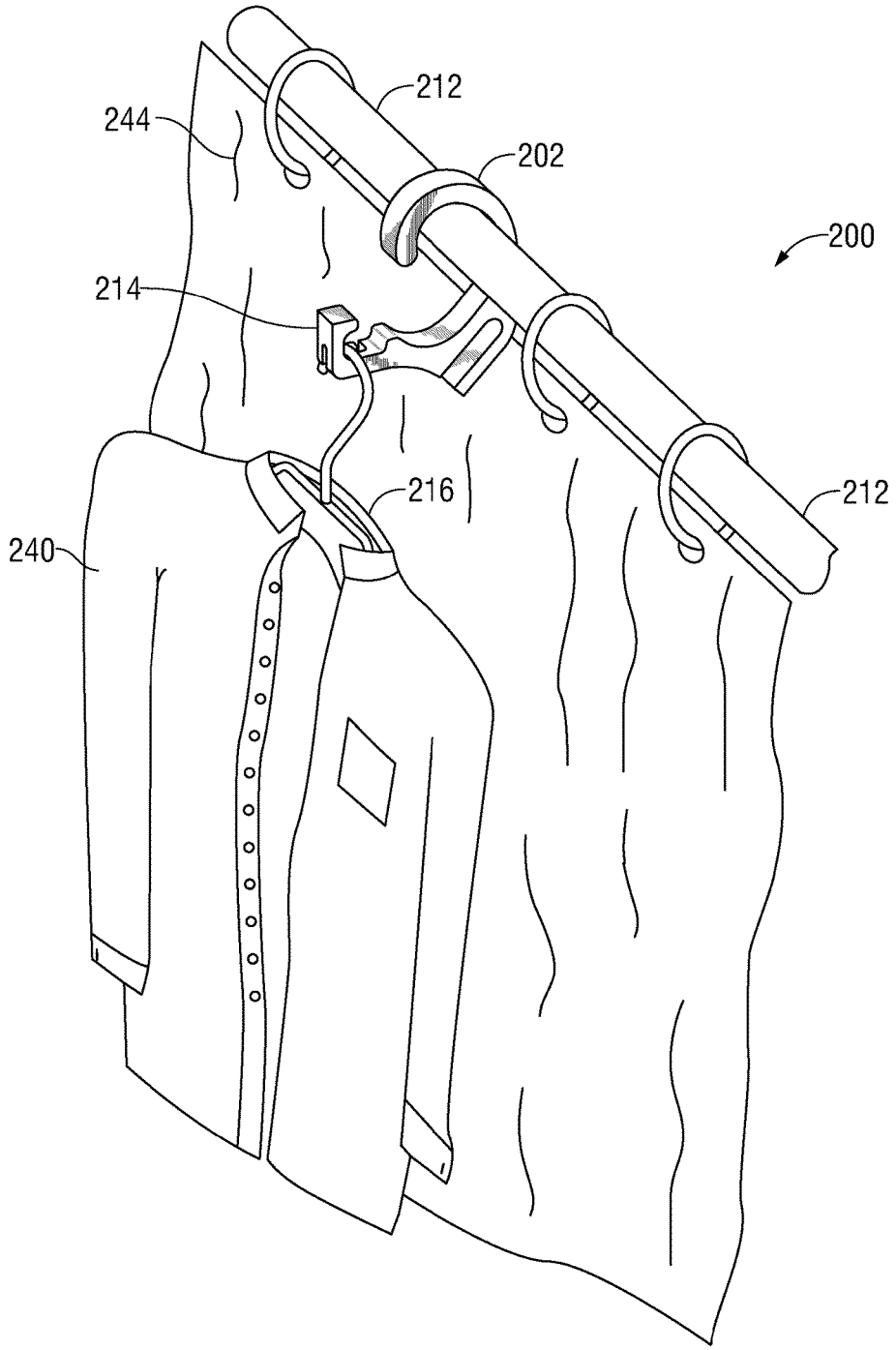
FIG. 8 depicts a method for hanging an apparel article from a shower curtain rod utilizing an embodiment of the disclosed device.
Figure 9:
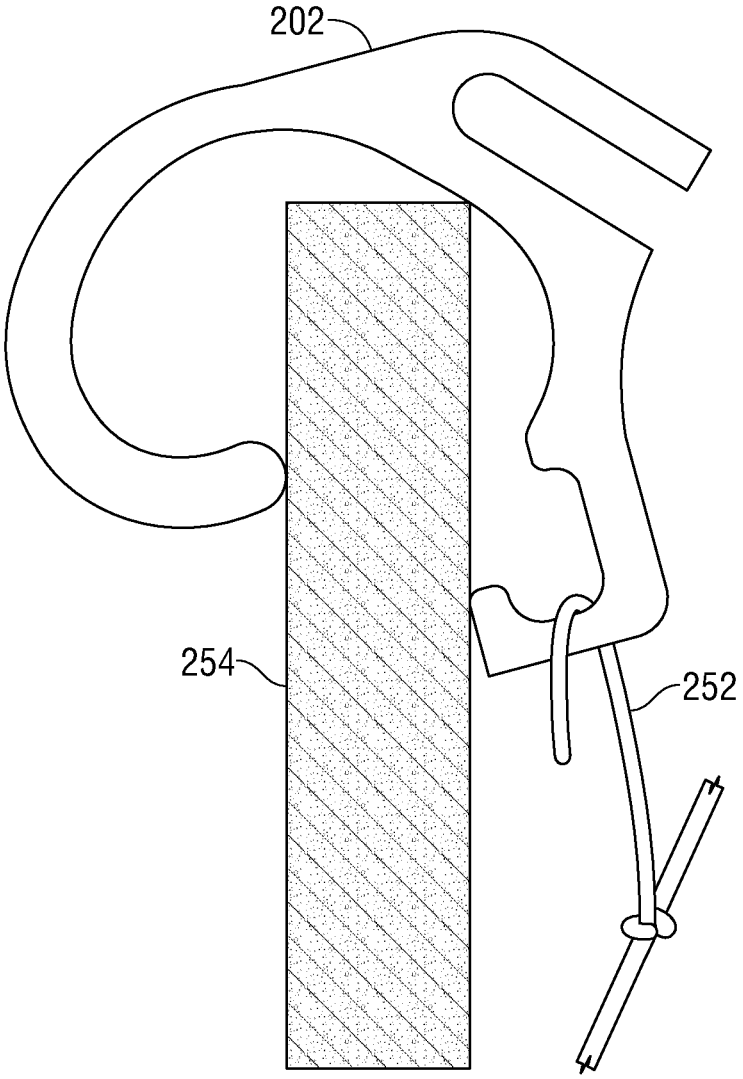
FIG. 9 depicts a method for hanging a hanger (and thus apparel article) from a door (or wall) utilizing an embodiment of the disclosed device.

FIG. 7 displays another possible embodiment method for retaining a hanger. The method may utilize any aforementioned configurations of apparatus 2. Method 200 may comprise providing a hanger retainer apparatus 202. A shower rod element 212 may then be surrounded at least partially by the major hook portion 224 thereof. Method 200 may further include positioning a standard hanger curved top 214 of a standard hanger 216 adjacent at least one of said major hook portion 224 and a second indentation 238. FIG. 8 thus shows the above method 200 through the retention of a garment 240 from the hanger retainer apparatus 224 within a room with a shower 242. In such a manner, the steam 244 from the shower 242 may decrease the amount of or eliminate wrinkles that may exist on the garment 240. FIG. 9 further shows the above method 200 through the retention of a hanger 252 from the hanger retainer apparatus 224 around the top of a door 254 (or it may also represent a properly configured wall). In such a manner, a garment (not illustrated) may be retained thereon the hanger 252 and subjected to steam (244 in FIG. 8, for instance) within the room in which the door 254 (or wall) is present.

As above, in embodiments, at least a portion of the first and second faces 204,206 may comprise sharp edges, and at least a portion of the first and second faces 204,206 may comprise rounded edges. As well, in embodiments, apparatus 202 may comprise a polymer (partially or completely); such a polymer may include, without limitation, polyethylene, polypropylene, polyacrylate, polycarbonate, and the like. In embodiments, additionally, apparatus 202 may comprise a metal, such as brass, aluminum, stainless steel, and the like, without limitation. Furthermore, as above, such an apparatus 202 may be comprised of a wooden material (including, without limitation, bamboo, cedar, cherry, walnut, mahogany, and the like).

Although specific embodiment of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

The invention claimed is:

1. A portable hanging apparatus for supporting a clothes hanger in spaced relation to a room feature, said apparatus comprising:

a portable unitary piece including a major hook portion having first and second faces disposed in opposed parallel relation, an interior portion, a first end spaced a distance from a second end, the interior portion having a surface, and an exterior portion having a surface, and wherein said major hook portion is present with a curved ovular configuration;

the major hook portion defining elements of a protruding portion comprising an exterior surface, the protruding portion extending a defined distance from the exterior portion of the major hook portion, an edge of the exterior surface aligning along a tangent of the interior portion of the major hook portion, a second edge of the exterior surface aligning along a tangent of the exterior portion of the major hook portion;

the major hook portion defining elements of a first indentation extending a defined distance within the protruding portion, the first indentation extending along an axis parallel with the exterior portion aligning along a tangent of the interior portion of the major hook portion;

the apparatus defining elements of a minor hook portion comprising a first extension portion, a second extension portion, a curved end, an interior surface, and an exterior surface, the first extension portion and the second extension portion positioned in a perpendicular relationship therewith, the first extension portion terminating at the second end of the major hook portion; and the minor hook portion defining elements of a second indentation adapted to receive a hanging portion of a hanger, the second indentation protruding from a side surface of the minor hook portion and extending a defined distance within the minor hook portion.

2. The apparatus of claim 1, the major hook portion affixable around at least a portion of a shower rod.

3. The apparatus of claim 1, the first indentation affixable around at least a portion of a glass shower door frame.

4. The apparatus of claim 1, the first indentation terminating at a rounded end.

5. The apparatus of claim 1, the second indentation terminating at a rounded end.

6. The apparatus of claim 1, the curved end of the minor hook portion inwardly extending toward the interior surface of the major hook portion.

7. The apparatus of claim 1, the first end inwardly extending toward the interior surface of the major hook portion.

8. The apparatus of claim 1, the second end outwardly extending away from the interior surface of the major hook portion.

9. The apparatus of claim 1, the distance from the first end of the major hook portion to the second end of the major hook portion being 1.5 inches.

10. The apparatus of claim 1, the second indentation continuous along a portion of the first extension portion and a portion of the second extension portion.

11. The apparatus of claim 1, the second indentation further comprising a recessed portion positioned within at least one of the first extension portion and the second extension portion.

12. The apparatus of claim 1, at least a portion of the first and second faces comprising sharp edges.

13. The apparatus of claim 1, at least a portion of the first and second faces comprising rounded edges.

14. The apparatus of claim 1, further comprising a polymer.

15. The apparatus of claim 1, further comprising a metal.

16. The apparatus of claim 1, further comprising a wooden material.

* * * * *